United States Patent [19]

Hechler

[11] Patent Number: 4,605,210

[45] Date of Patent: Aug. 12, 1986

[54] APPARATUS FOR FOLDING TRAVELING WEBS USING A SERIES OF ROLLER PAIRS

[75] Inventor: Hatto Hechler, Augsburg, Fed. Rep. of Germany

[73] Assignee: M.A.N.-Roland Druckmaschinen Aktiengesellschaft, Augsburg, Fed. Rep. of Germany

[21] Appl. No.: 763,805

[22] Filed: Aug. 8, 1985

[30] Foreign Application Priority Data

Aug. 8, 1984 [DE] Fed. Rep. of Germany ..... 3429172

[51] Int. Cl.[4] ..... B41L 1/30

[52] U.S. Cl. ..... 270/41; 270/42; 226/189; 493/398

[58] Field of Search ..... 270/32, 41–42, 270/5; 226/184–187, 189–190; 493/398, 445, 435

[56] References Cited

U.S. PATENT DOCUMENTS

| | | | |
|---|---|---|---|
| 1,085,948 | 2/1914 | Smith | 270/41 |
| 1,186,970 | 6/1916 | Cottrell | 270/41 |
| 4,265,437 | 5/1981 | Reist et al. | 493/435 |
| 4,279,409 | 7/1981 | Pemberton | 270/5 |
| 4,509,733 | 4/1985 | Pflaum et al. | 270/41 |
| 4,516,761 | 5/1985 | Ricciardi | 270/41 |

FOREIGN PATENT DOCUMENTS

| | | | |
|---|---|---|---|
| 7506576 | 6/1975 | Netherlands | 493/435 |

*Primary Examiner*—E. H. Eickholt

*Attorney, Agent, or Firm*—Frishauf, Holtz, Goodman & Woodward

[57] ABSTRACT

A plurality of folding stages, in which each folding stage carries out a folding operation, in steps, are provided. The folding stages each have a folding roller pair (2, 2'. . . 5, 5'), one each roller being located above, and one below the web or superposed webs (6) to be folded. The folding roller pairs, except for the first, are formed with matching groove - ridge profile. The folding roller pairs are offset, in coordinates in space, with respect to the coordinates of a first roller pair which has cylindrical shape, such that the spacing of adjacent folding stations, e.g. S1–S2, and the folding angle of the respective adjacent stations are related to the height offset of the downstream subsequent stage and the angular direction of a line passing through the centers of rotation of the respective rollers of the downstream pair in the downstream station, the relationship being so selected that the length dimension of a theoretical ridge line between adjacent stations corresponds at least approximately to the length dimension of a theoretical longitudinal line at the edge of the web between the same stations.

9 Claims, 5 Drawing Figures

APPARATUS FOR FOLDING TRAVELING WEBS USING A SERIES OF ROLLER PAIRS

The present application relates to folding apparatus, and more particularly to folding apparatus to be associated with printing machines, to provide a longitudinal fold in a traveling paper web, for example a printed paper web, and especially to fold a plurality of superimposed traveling paper webs.

BACKGROUND

It has previously been proposed—see, for example, the text "Techniken, Systeme, Maschinen" ("Technology, Systems, Machines"), by Oscar Frey, published by Polygraph-Verlag, 1979, pages 49 et seq.—to pull a plurality of printed paper webs, stacked above each other, over a folding former or folding triangle or funnel, to form a longitudinal fold therein. The web or webs are folded in one pass. The folding force is derived directly from the pulled web. The geometry of the folding former or similar structure causes the path of the web to change by about 90°. If a plurality of webs are superimposed above each other, differences in path length may occur so that reliable pull-off cannot always be ensured.

THE INVENTION

It is an object to improve the art of longitudinally folding one, and especially a plurality of superposed webs, and to substantially reduce and preferably entirely eliminate problems in connection with the folding of continuously moving webs.

Briefly, the longitudinal fold is continuously carried out in a plurality of folding steps by providing a plurality of folding stages located at different height levels with respect to the direction of a tangential ridge line of the material entering the respective stages, to define a height offset. Each folding stage includes folding roller pairs, the rollers of the pairs being located at opposite sides of the web, and the web being guided between the rollers to be folded in the respective steps or stages. The spacing of adjacent folding stages and the folding angle of respective adjacent stages, the height offset of a downstream stage, and the angular direction of a line contacting the centers of the rollers of the pairs are related to each other such that the length dimension of a theoretical ridge line between adjacent stages corresponds approximately to the length dimension of a theoretical edge line between corresponding adjacent stages.

DRAWINGS

In the specification and drawings, the principle of the invention, which may be referred to as a profiled folding principle, is described with respect to a coordinate system having three coordinates, in space, namely the coordinates X, Y, Z. A plurality of folding stages 1 to 5 are shown, and the coordinates at the respective folding stages having been given the subscripts A to E, corresponding to the stages 1 to 5. Further, a cross indication is provided in FIG. 2 which shows the center or zero or origin position of the respective coordinate axial system, the center being designated solely with the letter subscript of the respective stage. Thus, the axes $X_A$, $Y_A$, $Z_A$ designate the coordinates from the first stage, with the origin at A.

DETAILED DESCRIPTION

Figure 1:
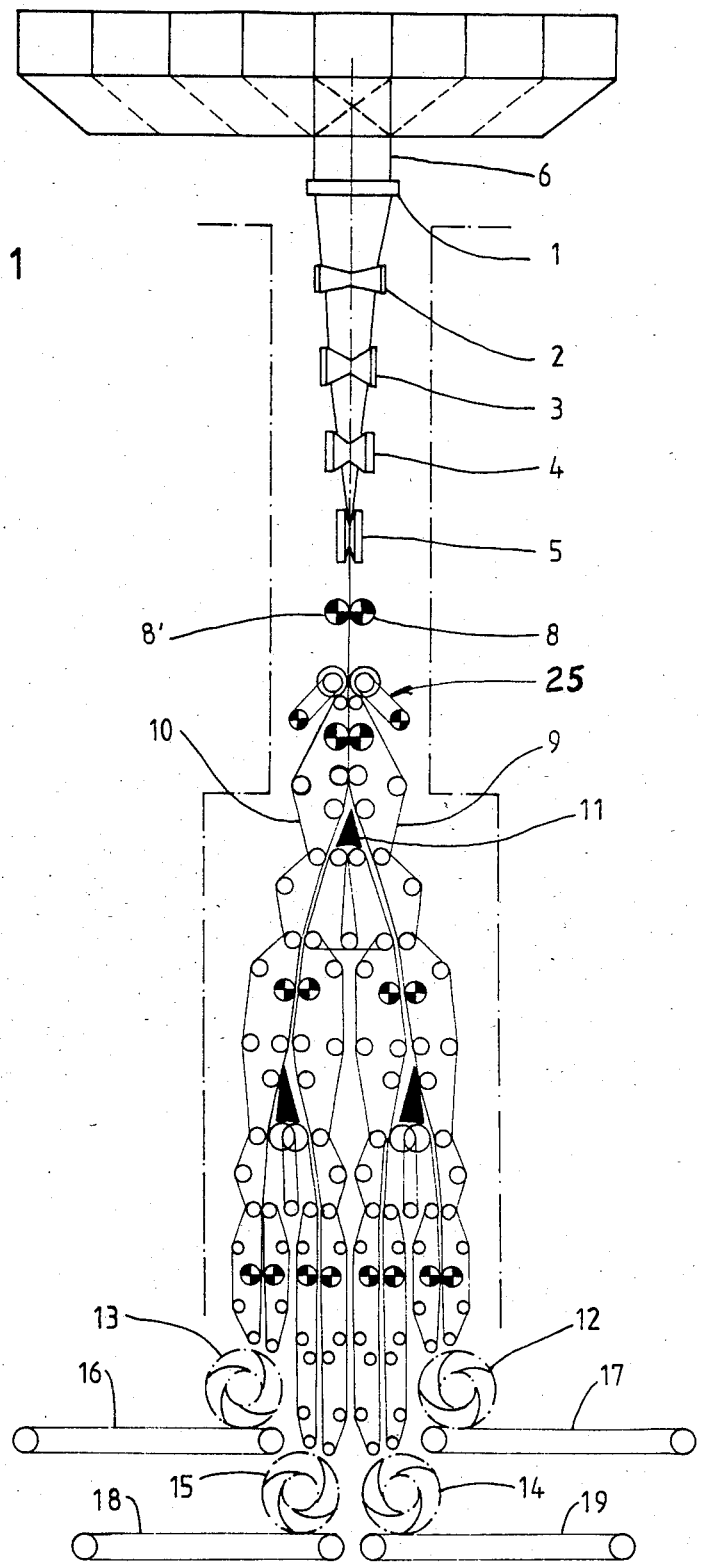
FIG. 1 is a schematic front view of the longitudinal folding apparatus.
Figure 2:
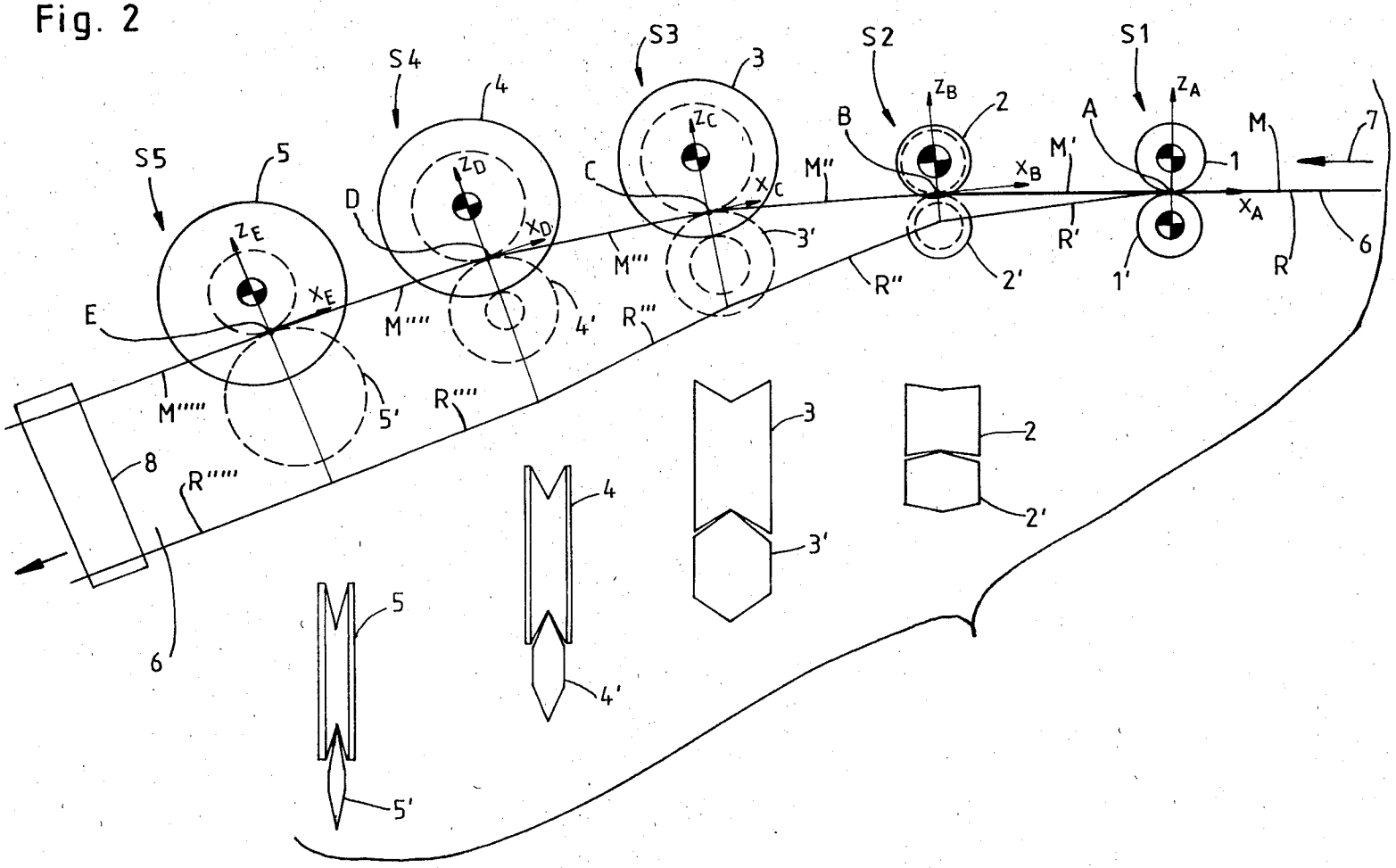
FIG. 2 is a side view of the longitudinal folding stages.

A printing machine—not shown—provides a paper web 6 (FIG. 1) to the folding apparatus in accordance with the present invention. The paper web 6 is to be folded in half in a plurality of stages S1 to S5, longitudinally, as the web travels from the top to the bottom in the illustration of FIG. 1. Each one of the stages S1 to S5 includes a pair of rollers 1, 1', 2, 2' . . . 5, 5' (FIG. 2). The web 6 is guided between the rollers of the roller pairs. The present invention is particularly applicable for folding not only a single web 6, but a plurality of webs 6, superimposed above each other. For simplicity of the drawing, only one single web is shown, although it is to be understood that the single-line representation of the web 6 (FIG. 2) is to equally include a plurality of superposed webs.

The web or webs 6 are moved or pulled in the direction of the arrow 7 (FIG. 2). Each one of the folding roller pairs 2, 2', 3, 3', 4, 4', 5, 5' is formed with an angular profile which is shown beneath the respective stages of FIG. 2 for ease of illustration. The upper rollers 2, 3, 4 have a V notch; the lower rollers 2', 3', 4', 5' have an edge which fits into the apex of the V of the upper roller with which it is associated, and between which the web or webs 6 are located. The roller pair 1, 1' does not have a notch-ridge combination but, rather, is formed by a pair of cylindrical rollers, which are used as a clamping and transport roller pair, that is, to pull the web through the machine and off the printing machine. Another roller pair 8, 8' is provided (see FIG. 1) between which the folded web or webs 6 are guided, the rollers 8, 8' pulling the folded web or webs through the folding machine.

The structure is particularly suitable to folding a plurality of superposed webs; a single web 6 may, of course, also be folded.

The respective folding stages are best seen in FIG. 2, in which the stages S2, S3, S4 and S5 are offset in height with respect to each preceding or neighboring stage. Consequently, the rollers of the pairs are located at respectively different height levels, resulting in a folding path which declines downwardly—see FIG. 2. The coordinates $Z_B$ to $Z_E$, passing through the centers of the folding roller pairs, are progressively inclined towards the left; the coordinate $Z_A$ is perpendicular to the web 6 passing between the rollers 1, 1'.

The shaping of the roller pairs 2, 2' . . . 5, 5' shows that the folding procedure is carried out in steps, from the right towards the left.

In accordance with a feature of the present invention, the longitudinal folding is carried out in accordance with the principle that, with a predetermined distance between two adjacent folding stages, e.g. from S1 to S2, the height offset of the subsequent folding stages, that is, the folding roller pairs 2, 2', is changed with respect to a preceding roller pair—in this case 1, 1'. The offset is in a downward direction, that is, in the direction of the fold. A plane passing through the folding roller pair 2, 2' or, rather, to the centers or axes of rotation thereof, is inclined towards the left, so that the spatial coordinate $Z_B$ likewise will be inclined towards the left. FIG. 2 shows this inclination which, with respect to the coordinate $Z_A$, is slight. The height offset, that is, the drop off a tangent perpendicular to the coordinate $Z_A$ of the stage S1, and the inclination of the coordinate $Z_B$, must be so dimensioned and selected that a theoretical central fiber or ridge line M' corresponds to the dimension of an associated edge fiber or edge line R'. This arrangement provides for relaxation of inner web tension occurring during the partial folding steps. Thus, the folding apparatus and method is particularly suitable to fold a plurality of superposed webs.

The folding force, in the structure of the present invention, is no longer taken from the tensioning of the web but, rather, is generated by the folding rollers 2, 2' . . . 5, 5' by pressure. Guidance of the portion of the web laterally of the folding ridge may be carried out—if desired—by guiding elements, for example by guide sheets or by suitably placed guide rollers.

The folding apparatus, in combination with an adjustable cutting apparatus, is variable as to format; this provides an additional advantage since it increases the versatility of the apparatus. Printing machines capable of handling extremely wide web material can supply the folding apparatus and problems in connection with superposition of a plurality of webs, all traveling together, are eliminated. The webs can be collected together in web handling structures which, as well known, are associated with printing machines at the trailing or output end thereof.

Figure 3:
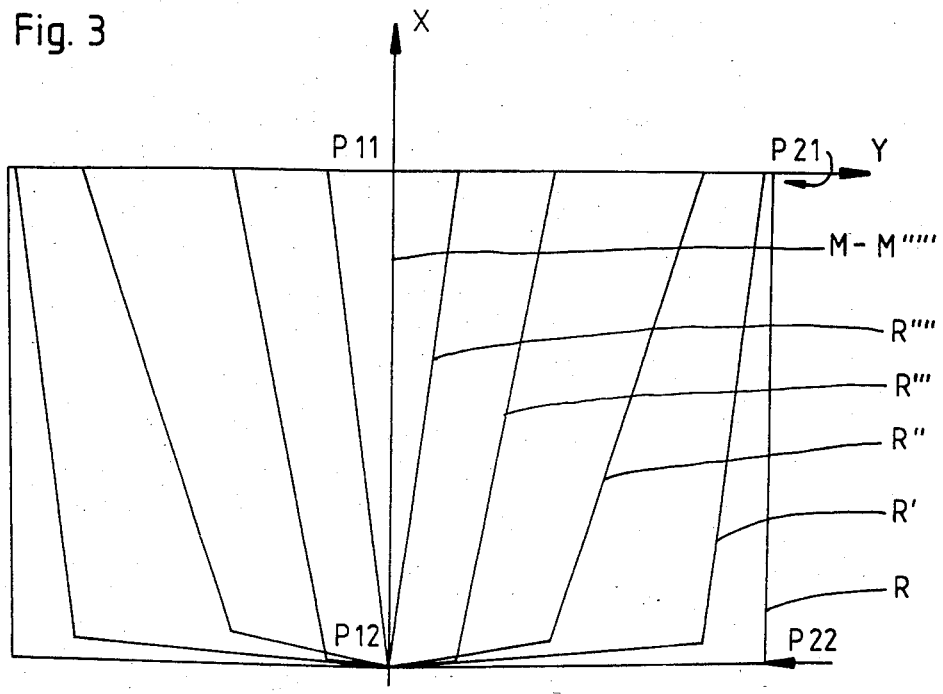
FIG. 3 is a development of the folding operation taken in the X-Y plane, as defined in FIG. 2.
Figure 4:
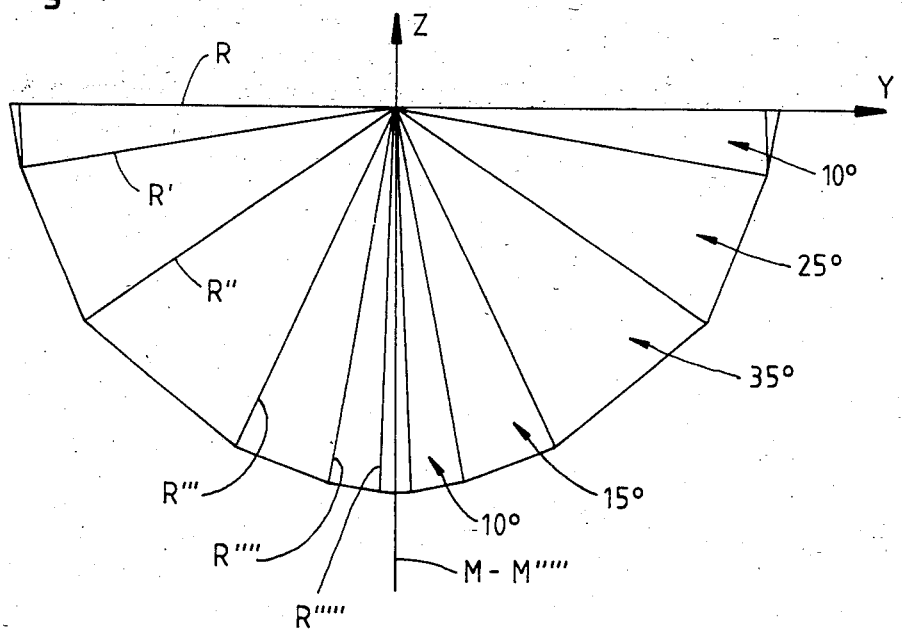
FIG. 4 is a development taken in the Y-Z plane.

Referring now specifically to FIGS. 2, 3 and 4: FIG. 3 shows a development of the web 6 between the respective stages S1 to S5 in the X-Y plane, and FIG. 4 in the Z-Y plane. The coordinates X and Z are shown in the respective drawings, the coordinate Y extending at right angles thereto in and out of the plane of the drawing, FIG. 2. The folding angles for the respective stages S1 to S5 are also shown in FIG. 4.

The developed views of FIGS. 3 and 4 clearly show that, with a predetermined distance between two folding stages, such as folding stages S1 and S2, the inclination and the height offset of the folding roller pair located downstream—in the direction of the path of the web—must be a predetermined value. In the illustration, the inclination of the Z axis passing through the centers of rotation of the two downstream folding rollers 2, 2' and the height offset must have a predetermined value so that the path length between the center or ridge line of the fold and an edge line R of the fold will be essentially similar and the past differences will be essentially compensated and made even.

It is necessary to individually calculate the inclination and the height offset from stage to stage. Preferably, the coordinates are calculated with respect to a coordinate center of each one of the stages S1 to S5, the coordinate centers being shown in FIG. 2. Calculation can be carried out by using well known trigonometric functions, and determination of the X components by the longitudinal length, in space.

Example, with respect to FIGS. 3 and 4:

FOLDING PROCESS

FIG. 3 utilizes point designations P with indices 1 and 2, in which the numeral 1 relates to the center or, after folding, to the ridge line of the web or webs, and the number 2 to the edge. The first number, that is, index 1 . . . n is the step before folding; the second, index 2 . . . (n+1) after the folding. The respective folding steps are taken in relation to the various stages.

The width of the web 6 before folding was 46 cm; after folding, the folded web was half as wide, that is, about 23 cm. Distance between folding rollers, that is, from right to left (FIG. 2), was about 30 cm.

Stage 1:
The folding angle assumed is 10°
Coordinates at the origin of the axes A:

$P_{11}$ ($X_A=0$; $Y_A=0$; $Z_A=0$)
$P_{21}$ ($X_A=0$; $Y_A=230$; $Z_A=0$)

$P_{12}$ ($X_A=300$; $Y_A=0$; $Z_A=0$)
$P_{22}$ ($X_A=-297.33$, $Y_A=226.51$; $Z_A=-39.94$)

Stage 2:
Assumed folding angle: 25°
(Change in length $P_{21}$ by a different origin of the axes or coordinates: 0.06 mm).
Coordinates at the origin of the axes or coordinates B:

$P_{12}$ ($X_B=0$; $Y_B=0$; $Z_B=0$)
$P_{22}$ ($X_B=0$; $Y_B=226.51$; $Z_B=-40.02$)

$P_{13}$ ($X_B=-300$; $Y_B=0$; $Z_B=0$)
$P_{23}$ ($X_B=-282{,}69$; $Y_B=188.40$; $Z_B=-132.92$)

Calculation of the X-component by the lateral length, in space $$d = \sqrt{(X_B - X_A)^2 + (Y_B - Y_A)^2 + (Z_B - Z_A)^2)}$$

Stage 3:
Assumed folding angle: 30°
Coordinates at the origin C:

$P_{13}$ ($X_C=0$; $Y_C=0$; $Z_C=0$)
$P_{23}$ ($X_C=0$; $Y_C=188.40$; $Z_C=-134.04$)

$P_{14}$ ($X_C=-300$; $Y_C=0$; $Z_C=0$)
$P_{24}$ ($X_C=-275.94$; $Y_C=97.20$; $Z_C=-208.45$)

Stage 4:
Assumed folding angle: 15°
Coordinates at the origin D:

$P_{14}$ ($X_D=0$; $Y_D=0$; $Z_D=0$)
$P_{24}$ ($X_D=0$; $Y_D=97.20$; $Z_D=-209.83$)

$P_{15}$ ($X_D=-300$; $Y_D=0$; $Z_D=0$)
$P_{25}$ ($X_D=-293.93$; $Y_D=39.44$; $Z_D=-226.51$)

Stage 5:
Assumed folding angle: 10°
Coordinates at the origin of the axes E;

$P_{16}$ ($X_E=0$; $Y_E=0$; $Z_E=0$)
$P_{26}$ ($X_E=0$; $Y_E=39.94$; $Z_E=-226.59$)

$P_{17}$ ($X_E=-300$; $Y_E=0$; $Z_E=0$)
$P_{27}$ ($X_E=-300$; $Y_E=0$; $Z_E=-230$)

When using the previously listed coordinates, the various positions of the folding roller pairs 2, 2' to 5, 5', in space, can be determined, in relation to the first pair 1, 1′ of rollers. This insures that the center or ridge fiber, or a theoretical ridge line corresponding thereto, namely the line M′, M″, M‴, M⁗, M′′′′′ corresponds to the respectively associated edge line or edge fiber R′, R″, R‴, R⁗, R′′′′′. Misalignment, creasing, wrinkling, and even crumpling of the web 6, and particularly of a plurality of superposed webs, no longer occurs.

The longitudinal folding apparatus is particularly suitable for association with subsequent paper handling apparatus. Referring again to FIG. 1: The paper products are guided through the pulloff rollers 8, 8′, in which the center axes or shafts are shown in the same coordinate representation as in FIG. 2 with respect to the folding rollers. The web is cut into longitudinal cut portions by suitable cutters 25, shown in detail, since they may be of any well known construction, and then guided to transport webs or belts 9, 10, possibly via directing switches 11. After having been split up into a plurality of paths, which may include delay stages, the folded products are then supplied to bucket wheels 12, 13, 14, 15 for further distribution on output transport belts 16 to 19, for example in imbricated arrangement, in which the respective printed products are supplied in overlapped condition. Example of calculation, and of deformation:

Determination of coordinates after a first deformation:

Center or ridge line M after deformation:

Point 12: $X_A=-300$; $Y_A=0$, $Z_A=0$

Edge line of the web after deformation:

Point 22: $X_A=-297.33$; $Y_A=226.51$; $Z_A=-39.94$

Figure 5:
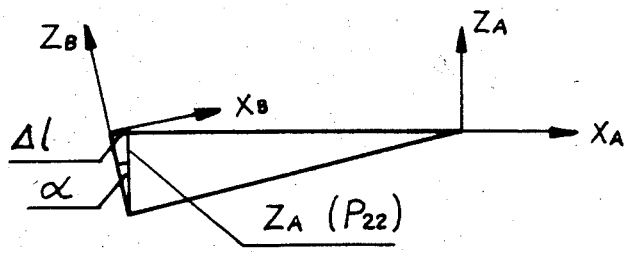
FIG. 5 is a coordinate diagram used in connection with a calculation described below.

Second stage:

A new origin of axes B is determined which corresponds to the inclination of the edge line. The edge $\alpha$ of the origin coordinate system will be obtained in accordance with FIG. 5.

Longitudinal difference between the edge line and the ridge line M, taken from the edge line:

$$\Delta l = -300 - (-297{,}33) = -2{,}67$$

$$Z_A = -39{,}94$$

$$\tan\alpha = \frac{-2{,}67}{-39{,}94}$$

$$= 3{,}824°$$

The prior terminal coordinates in the coordinate origin A then become the original coordinates in the coordinate origin B. Only the numerical value for Z will change as follows:

$$\frac{Z_A}{Z_B} = \cos\alpha$$

$$Z_B = \frac{Z_A}{\cos 3{,}824°} = -40{,}02$$

Theoretical ridge line M prior to deformation:

$P_{12}$: $X_B=0$; $Y_B=0$; $Z_B=0$

Edge line prior to deformation:

$P_{22}$: $X_B=0$; $Y_B=226.51$; $Z_B=-40.02$

Calculation of coordinates after deformation, folding angle additional 25°.

Theoretical ridge line M after deformation:

Point 13: $X_B=-300$; $Y_B=0$; $Z_B=0$

Edge line after deformation

Point 23:

$$\frac{Y_B}{230} = \cos 35°$$

$$Y_B = 188{,}40$$

$$\frac{Z_B}{230} = \sin 35°$$

$$Z_B = -132{,}92$$

Calculation of the x-component by the lateral length, in space:

$$300 = \sqrt{(X_B - 0)^2 + (188{,}40 - 226{,}51)^2 + (-132{,}92 - (-40{,}02))^2}$$

$$X_B = -282{,}69$$

Location of coordinates after deformation:

Theoretical ridge line M after deformation:

Point 13: $X_B=300$; $Y_B=0$; $Z_B=0$

Edge line after deformation:

Point 23: $X_B=-282.69$; $Y_B=188.40$; $Z_B=-132.92$

Stage 3:

A new origin of coordinates, C, is generated, which corresponds to the inclination of the edge line. The inclination of the coordinates of the coordinate origin is calculated as before:

Longitudinal difference:

$$\Delta l = -300 - (-282{,}69) = -17{,}31$$

$$\tan\beta = \frac{-17{,}31}{-132{,}92}$$

$$\beta = 7{,}42°$$

The remainder of the calculation is carried out as illustrated in the foregoing.

I claim:

1. Folding apparatus to fold a traveling web, or a plurality of superposed traveling webs (6), especially printed material or products received from a printing machine, about a theoretical ridge line (M, M′) to thereby fold together said web and define two folded edge lines (R, R′ . . . ), comprising, in accordance with the invention, a plurality of folding stages (S1 . . . S5), located at different height levels with respect to the direction of a theoretical ridge line of the material entering a first stage, and to define height offsets of the respective stages with respect to said first stage (S1), each folding stage including a folding roller pair (1, 1′ . . . 5, 5′), the rollers (1, 2 . . . 5; 1′, 2′ . . . 5′) of the pair being located at opposite sides of the web or superposed webs (6) and the web or superposed webs being guided between the rollers of the pairs, to be folded thereby, in steps;

and wherein the spacing of adjacent folding stages (e.g. S1–S2), and the folding angle of the respective adjacent adjacent stages are related to the height offset of the downstream subsequent stage (S2)—in the direction of travel of the web— and the angular direction of a line (Z) connecting the centers of the rollers of the pair (2, 2') of the downstream stage, such that the length dimension of the theoretical ridge line between adjacent stages (S1–S2) corresponds at least approximately to the length dimension of the theoretical longitudinal edge lines (R) of the web between the corresponding adjacent stages (S1–S2).

2. Apparatus according to claim 1, wherein the ridge line is located in the center of the web;

and the position of the theoretical longitudinal edge lines is located at the edge limits of the web.

3. Apparatus according to claim 1, wherein four folding roller pairs (2, 2' . . . 5, 5') are provided, the rollers of the pair above the fold being formed with a V groove, and the rollers of the pair below the web being formed with a ridge or edge fitting into the apex of the V groove, with the web or superimposed webs (6) therebetween;

and wherein a first clamping roller pair (1, 1) is provided, upstream of said four roller pairs and having essentially cylindrical configuration.

4. Apparatus according to claim 3, further including a pull-off roller pair (8) of essentially cylindrical configuration having mutually facing surfaces located in the folding plane.

5. Apparatus according to claim 2, wherein the spacing between folding stages (S1–S2; S2–S3 . . . ) comprises about 30 cm;

the web or superposed webs (6) have a transverse dimension of about 46 cm;

and wherein the folding angles of subsequent folding roller pairs is:

10°, 25°, 30°, 15°, 10° and wherein the vertical offset of the folding stages (S2 to S5) with respect to Cartesian coordinates, in space, of the first stage having essentially cylindrical rollers and the inclination of lines connecting the respective rollers of the roller pairs of the stages ($Z_b$ to $Z_e$) will have the following coordinates:

A. Center of web—theoretical ridge line M 1. before folding:

($X_A=0$; $Y_A=0$; $Z_A=0$)
($X_B=0$ ; $Y_B=0$; $Z_B=0$)
($X_C=0$; $Y_C=0$; $Z_C=0$)
($X_D=0$; $Y_D=0$; $Z_D=0$)
($X_E=0$; $Y_E=0$; $Z_E=0$)

2. after folding:

($X_A=-300$; $Y_A=0$; $Z_A=0$)
($X_B=-300$; $Y_B=0$; $Z_B=0$)
($X_C=-300$; $Y_C=0$; $Z_C=0$)
($X_D=-300$; $Y_D=0$; $Z_D=0$)
($X_E=-300$; $Y_E=0$; $Z_E=0$)

B. Edge line of the web 1. before folding ($X_A=0$; $Y_A=230$; $Z_A=0$)
($X_B=0$; $Y_B=226.51$; $Z_B=-40.02$)
($X_C=0$; $Y_C=188.40$; $Z_C=-134.04$)
($X_D=0$; $Y_D=97.20$; $Z_D=-209.83$)
($X_E=0$; $Y_E=39.94$; $Z_E=-226.59$)

2. after folding:

($X_A=-297.33$; $Y_A=226.51$; $Z_A=-39.94$)
($X_B=-282.69$; $Y_B=188.40$; $Z_B=-132.92$)
($X_C=275.94$; $Y_C=97.20$; $Z_C=-208.45$)
($X_D=-293.93$; $Y_D=39.44$; $Z_D=-226.51$)
($X_E=-300$; $Y_E=0$; $Z_E=230$).

6. Apparatus according to claim 1, further including folded paper handling apparatus comprising cutter means (25), paper product transport means (9, 10) paper product switching means (11), bucket distribution wheel means (12–15) and transport belt means (16–19) for supplying folded, cut, and sorted paper products in imbricated position.

7. Apparatus according to claim 1, wherein the spacing of the folded stages is between ½ to 1 times the width of the unfolded web.

8. Apparatus according to claim 1, wherein at least three folding stages are provided, and the folding angle of the central stage between the first and last stage is larger than that of the first and last stage.

9. Apparatus according to claim 1, wherein the number of folding stages, and the folding angles are arranged and selected to provide for lesser folding angles adjacent terminal positions of the web, and a larger folding angle or larger folding angles between said terminal positions.

* * * * *